US005573186A

United States Patent [19]

Loschelder

[11] Patent Number: 5,573,186

[45] Date of Patent: Nov. 12, 1996

[54] STATIONARY VENTURI DIVERTER VALVE

[75] Inventor: Todd C. Loschelder, Macedonia, Ohio

[73] Assignee: Moen Incorporated, North Olmsted, Ohio

[21] Appl. No.: 406,480

[22] Filed: Mar. 20, 1995

[51] Int. Cl.[6] ..... B05B 1/32

[52] U.S. Cl. ..... 239/445

[58] Field of Search ..... 239/436, 25, 27, 239/289, 443, 444, 445, 588; 137/627.5, 637, 883

[56] References Cited

U.S. PATENT DOCUMENTS

| | | | |
|---|---|---|---|
| 222,680 | 12/1879 | Dows | 239/445 X |
| 332,731 | 12/1885 | Miller | 239/445 |
| 960,675 | 6/1910 | Murphy | 239/445 |
| 1,556,979 | 10/1925 | Uschman | 239/444 X |
| 1,777,434 | 10/1930 | Herzbrun . | |
| 2,507,467 | 5/1950 | Fredrickson et al. . | |
| 2,508,958 | 5/1950 | Manville | 239/444 X |
| 2,767,019 | 10/1956 | Manville | 239/444 X |
| 2,894,695 | 7/1959 | Bletcher et al. . | |
| 2,949,240 | 8/1960 | Koolnis | 239/444 X |
| 2,977,988 | 4/1961 | Drobilits et al. . | |
| 3,533,554 | 10/1970 | Mongerson | 239/27 |
| 3,736,959 | 6/1973 | Parkinson . | |
| 4,200,124 | 4/1980 | Stratynski et al. . | |
| 4,261,332 | 4/1981 | Stewart . | |
| 4,301,972 | 11/1981 | Rudelick . | |
| 4,314,673 | 2/1982 | Rudelick . | |
| 5,213,131 | 5/1993 | Gnauert et al. . | |
| 5,495,681 | 3/1993 | Ghyen | 239/25 |

*Primary Examiner*—Kevin Weldon

*Attorney, Agent, or Firm*—Dorn, McEachran, Jambor & Keating

[57] ABSTRACT

A faucet diverter valve for directing water to either a faucet discharge or to an alternate water flow device such as a spray includes a valve body having an inlet, a faucet outlet, and an alternate water flow device outlet. There is a chamber in the valve body with the inlet and outlets opening into the chamber. A stationary diverter valve member is positioned within the chamber. A portion of the diverter valve member and the chamber wall form a restricted water flow passage therebetween. There is a water passage in the valve member connecting the valve body inlet and the upstream side of the restricted passage. The alternate water flow device outlet is located at the downstream side of the restricted passage. The valve member has openings therein positioned adjacent to and in communication with the restricted water flow passage. There is a flow path in the valve member connecting the valve member openings and the faucet outlet. When there is no water flow to the alternate water flow device, water from the valve body inlet flows to the restricted water flow passage, through the valve member openings and to the valve body faucet outlet. When the alternate water flow device is operated and water flows thereto, the water flow is through the restricted water passage and past and not into the valve member openings because of the increased velocity of water flow through the restricted water flow passage.

6 Claims, 1 Drawing Sheet

Fig.1.
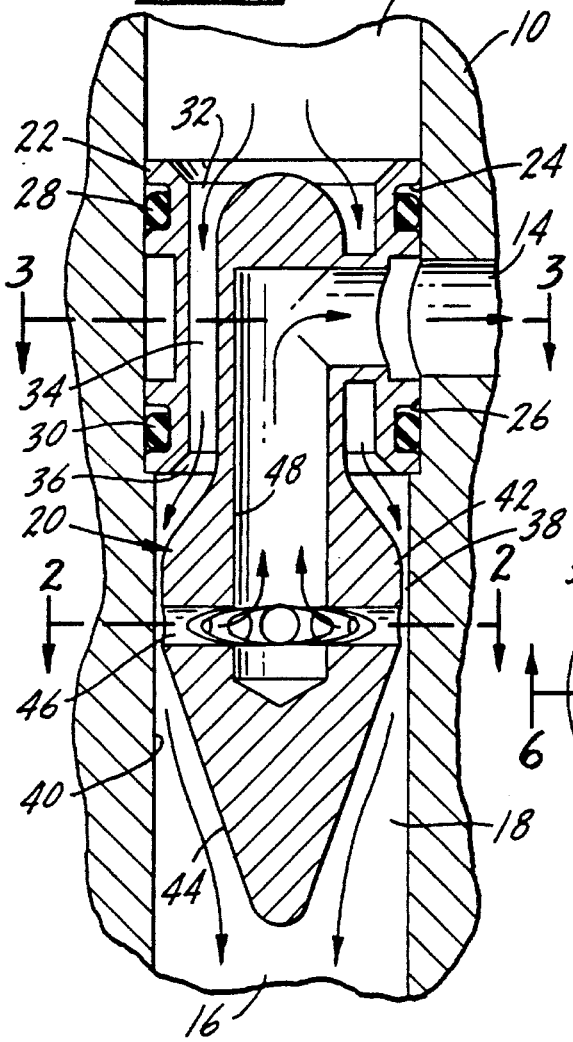
Fig.4.
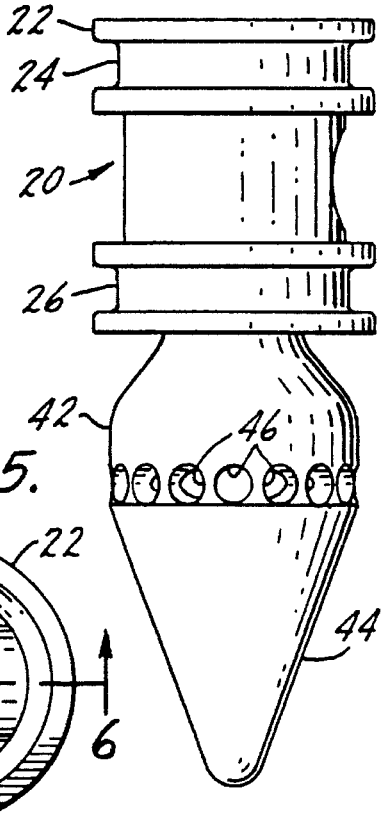
Fig.5.
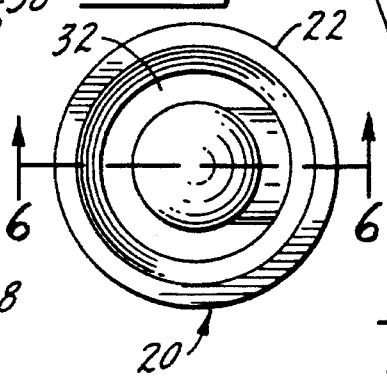
Fig.6.
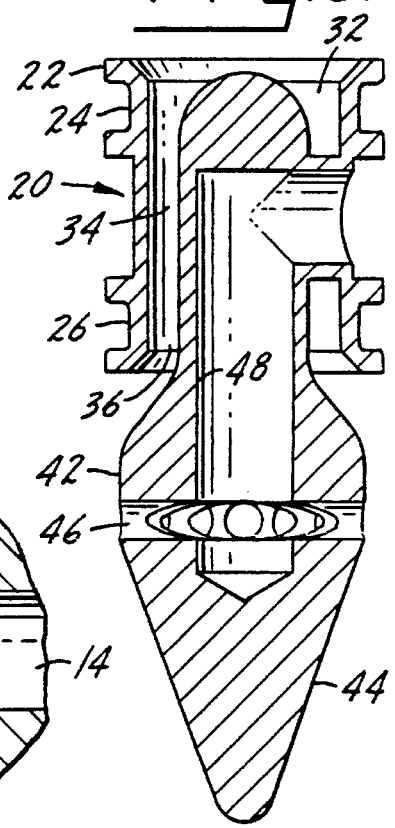
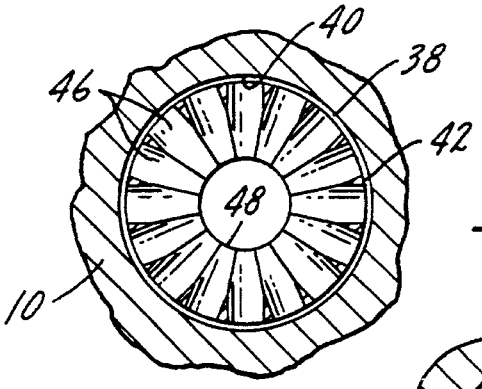
Fig.2.
Fig.3.
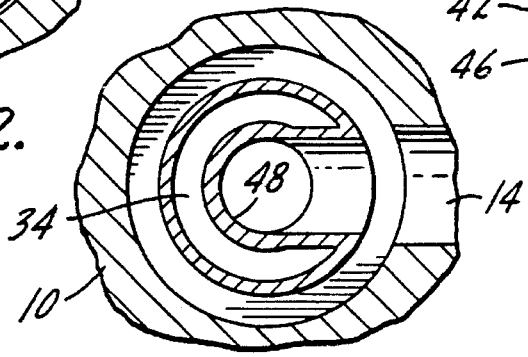

STATIONARY VENTURI DIVERTER VALVE

THE FIELD OF THE INVENTION

The present invention relates to diverter valves of the type customarily found in kitchen faucets and which are useful to direct water either to the conventional discharge through an aerated faucet spout or to an alternate discharge such as a movable spray head. Traditionally, such diverter valves have utilized a movable valve element and dynamic seals. The present invention is particularly concerned with a diverter valve which is stationary, has no moving parts and no dynamic seals.

SUMMARY OF THE INVENTION

The present invention relates to diverter valves for kitchen faucets and in particular to a diverter valve which has no moving parts.

A primary purpose of the invention is a simply constructed, reliably operable diverter valve for use in a kitchen faucet to direct water to either the conventional aerated spout or to an alternate discharge such as a hand-held spray.

Another purpose of the invention is a diverter valve as described which has no dynamic seals.

Another purpose is a diverter valve as described which has no moving components and only a single stationary valve member.

Another purpose is a diverter valve as described which uses a venturi to prevent water flow to the faucet spout when the spray is operated.

Other purposes will appear in the ensuing specification, drawings and claims.

BRIEF DESCRIPTION OF THE DRAWINGS

The invention is illustrated diagrammatically in the following drawings wherein:

Fig.1 is an axial section through the diverter valve of the present invention;

FIG. 2 is a section along plane 2—2 of FIG. 1;

FIG. 3 is a section along plane 3—3 of FIG. 1;

FIG. 4 is a side view of the valve member;

FIG. 5 is an end view of the valve member; and

FIG. 6 is a section along plane 6—6 of FIG. 5.

DESCRIPTION OF THE PREFERRED EMBODIMENT

The present invention relates to faucet diverter valves of the type customarily found with a kitchen faucet to provide an alternate discharge through either the aerated spout of the faucet or through a hand-held spray. In the drawings, the valve body of the faucet is indicated at 10 and has an inlet 12 which receives a supply of water, either all hot, all cold, or a mixture of the two. The valve body 10 has a faucet discharge 14 and a conduit 16 which leads to a hose for a hand-held spray. The valve body 10 has a chamber 18 which connects the described inlet and two outlets.

Fixed in position within the chamber 18 is a valve member 20. The valve member has an enlarged cylindrical area 22 having a pair of spaced circumferential grooves 24 and 26 within which are positioned seal rings 28 and 30 which effectively seal the inlet 12 from the faucet discharge 14 and the spray conduit 16.

The valve member 20 has a partially peripheral inlet 32 which is in communication with the valve body inlet 12 and connects to circumferentially disposed flow passage 34 which direct the water axially from the inlet 32 to an opening 36 which extends peripherally about the valve body 20. The opening 36 will discharge water from the inlet 12 peripherally about the valve member and upstream of a flow restriction 38 which is formed between the wall 40 of the chamber 18 and a portion 42 of the valve member 20. The peripheral area between the chamber wall 40 and the portion 42 of the valve member 20 forms a venturi. The space adjacent and upstream of portion 42 gradually increases in diameter toward the outlet 36. The diameter of the valve member 20 downstream of the portion 42 gradually decreases in diameter, as indicated at 44, in the direction of flow toward the discharge conduit 16.

At or adjacent the flow restriction 38 there are a plurality of radially extending water passages 46 which connect the exterior of valve member 20 at the venturi area 38 with an interior Water passage 48, with the passage 48 extending axially and then radially to connect and communicate with the faucet discharge 14 in the valve body 10.

When there is no flow through the valve member, and both the faucet is closed and the spray head is unoperated, water will fill all of the described chambers and passages. When the faucet is operated to provide an aerated discharge at the spout, water will flow from the inlet 12, to the valve member inlet 32, through passage 34 and opening 36 and to the venturi or restricted passage 38. Because the spray is closed, water will then flow inwardly through the radially extending passages 46, through passage 48, and to the faucet discharge 14.

At such time as the spray hose or the alternate discharge device is opened, the water flow path changes. As the water flows through the venturi or restricted area 38, the velocity of the water in this area increases and there is a low pressure area created thereby which draws air from the faucet spout through outlet 14 and passage 48 and then outwardly through the radial passages 46. This provides aeration for the water flowing to the spray head. Water does not flow inwardly through the passages 46, as the water is accelerated in its flow past these openings and because of the low pressure area created thereby which pulls air as described.

No dynamic or mechanical seals are needed to prevent water from flowing to the faucet spout when the spray hose is operated. The diverter has no moving components. The only seals are the static seals 28 and 30 which prevent water from exiting to the spout or spray except through the described water passages.

Whereas the preferred form of the invention has been shown and described herein, it should be realized that there may be many modifications, substitutions and alterations thereto.

The embodiments of the invention in which an exclusive property or privilege is claimed are defined as follows:

1. A faucet diverter valve for directing water to either a faucet discharge or to an alternate water flow device including a valve body having an inlet, a faucet outlet, and an alternate water flow device outlet, a chamber in said valve body, said chamber having a wall, said inlet and outlets opening into said chamber, a stationary valve member positioned within said chamber, a portion of said valve member and said chamber wall forming a restricted water flow passage therebetween, water passage means in said valve member connecting said valve body inlet and the upstream side of said restricted passage, said alternate water flow device outlet being located at the downstream side of said restricted passage, said valve member having openings therein positioned adjacent to and in communication with said restricted water flow passage, and a flow path in said valve member connecting said valve member openings and said faucet outlet, when there is no water flow to an alternate water flow device, water from said valve body inlet flows to said restricted water flow passage, through said valve member openings to said valve body faucet outlet, when there is flow to an alternate water flow device, water flows through said restricted passage and past and not into said valve member openings because of the increased velocity of water flow through said restricted water flow passage.

2. The diverter valve of claim 1 wherein there are seal means between said valve body and chamber wall separating said valve body inlet from said valve body outlets.

3. The diverter valve of claim 1 wherein said restricted passage gradually increases in size in both the upstream and downstream directions from the area of greatest restriction adjacent said valve member openings.

4. The diverter valve of claim 3 wherein said valve member openings extend radially in a direction generally perpendicular to the path of flow through said restricted passage.

5. The diverter valve of claim 4 wherein said valve member flow path extends in part axially and in part radially outwardly through said valve member.

6. The diverter valve of claim 3 wherein said chamber wall is uniform and of constant diameter, with the outer diameter of said valve member in the area of said restricted passage gradually decreasing in both the upstream and downstream directions from an area of greatest diameter adjacent said valve member openings.

* * * * *